United States Patent [19]

Cecka

[11] 4,114,880

[45] Sep. 19, 1978

[54] TENNIS RACKET ASSEMBLY

[75] Inventor: Andrew M. Cecka, Thousand Oaks, Calif.

[73] Assignee: Fansteel, Inc., North Chicago, Ill.

[21] Appl. No.: 841,939

[22] Filed: Oct. 13, 1977

[51] Int. Cl.[2] ..... A63B 49/10

[52] U.S. Cl. ..... 273/73 G; 273/73 F

[58] Field of Search ..... 273/73 R, 73 C, 73 D, 273/73 F, 73 G, 73 K, DIG. 7, DIG. 23

[56] References Cited

U.S. PATENT DOCUMENTS

| | | | |
|---|---|---|---|
| 2,878,020 | 3/1959 | Robinson | 273/73 F |
| 3,313,541 | 4/1967 | Benkoczy et al. | 273/DIG. 7 |
| 3,691,000 | 9/1972 | Kalnin | 273/DIG. 23 |
| 3,700,535 | 10/1972 | McCoy et al. | 273/DIG. 23 |
| 3,915,453 | 10/1975 | Nishimura | 273/73 G |
| 3,981,502 | 9/1976 | Portz | 273/73 G |
| 3,993,308 | 11/1976 | Jenks | 273/73 F |
| 4,023,799 | 5/1977 | Van Auken | 273/73 F |
| 4,023,801 | 5/1977 | Van Auken | 273/DIG. 7 |
| 4,043,074 | 8/1977 | Airhart | 273/DIG. 23 |
| 4,045,025 | 8/1977 | Staub et al. | 273/73 G X |

FOREIGN PATENT DOCUMENTS

| | | | |
|---|---|---|---|
| 2,505,454 | 8/1975 | Fed. Rep. of Germany | 273/73 F |
| 6,456 of | 1885 | United Kingdom | 273/73 G |
| 142,414 | 5/1920 | United Kingdom | 273/73 G |
| 280,759 | 11/1927 | United Kingdom | 273/73 G |
| 858,169 | 1/1961 | United Kingdom | 273/73 G |

*Primary Examiner*—Richard J. Apley

*Attorney, Agent, or Firm*—Dressler, Goldsmith, Clement, Gordon & Shore, Ltd.

[57] ABSTRACT

A tennis racket assembly comprising a long structural member, a short structural member and two yoke pieces at the junction of said members. The long member extends from the grip end of the handle, up one side the handle, around the major portion of the ellipsoid head and down the other side of the handle to the grip end. The short member extends across the throat of the racket and completes the ellipsoid shape of the head, joining the long member at two junctions.

Each yoke piece has the external shape of the letter "Y" and has at least two branch portions and a trunk portion. The trunk portion of each yoke piece is wrapped around a portion of the long member between the junction and the head of the racket, one branch portion of each yoke piece overlies a surface at one end of the short member, and the other end of each yoke piece overlies an opposite surface at said end of said short member.

9 Claims, 5 Drawing Figures

TENNIS RACKET ASSEMBLY

BACKGROUND OF THE INVENTION

This invention relates to a lightweight, high strength and stiffness composite tennis racket assembly that provides superior performance. The invention also provides a method of making such a structure.

The earliest tennis rackets utilized frames of solid wood, but these were superseded by laminated wood construction, such as selected ash, maple and birch laminates, sometimes with built-in, steel-like fibers.

Later, tennis rackets with metal frames, such as tubular round, channel, I-beam extrusions and other configurations, were developed constructed from alloy steel, magnesium and especially aluminum.

Also, composite laminated fiber glass reinforced plastic tennis rackets have been produced by techniques such as injection molding, transfer molding and compression molding.

In copending and coassigned Application Ser. No. 720,514, filed by Andrew M. Cecka and Pol Dano on Sept. 3, 1976, there is described a tennis racket comprising an assembly of a long structural member and a short structural member, each comprising foamed plastic core integrally bonded to a shell comprising a plurality of layers of resin-coated unidirectionally oriented graphite fibers at least one of the layers having fibers oriented in a direction different from the direction of orientation in at least one other layer, the shell completely encasing the core at any transverse cross section of the structural member. Each of the structural members is prepared by arranging within a mold cavity an outer shell made of a plurality of layers of unidirectionally oriented graphite fibers and a core comprising a foamable composition, sealing the mold and activating the foamable resin composition to cause expansion and generate pressure within the mold cavity and thereby provide intimate bonding of the core to the shell.

The tennis racket of the aforementioned copending application has a handle and an ellipsoid head attached to one end thereof, with a grip element at the opposite end of the handle. One end of the long structural member is at the grip end of the handle; and the long structural member then stretches along one side of the handle, around a major portion of the head then down the other side of said handle to the grip end. The short structural member extends around a minor portion of the head, or across the throat of the racket, to complete the ellipsoid shape of the racket head. The ends of the short structural member are joined to the long structural member at junction points.

The aforementioned copending application describes the short structural element as "spliced" to the long element to obtain the assembly and complete the closed ellipsoid shape of the frame. In practice in the commercial manufacture of the tennis racket described in said application, the splicing is achieved in end extensions of the graphite fiber jackets beyond the ends of the core of the short element.

Specifically, the cross-plied graphite sheet layers wrapped around the core of the short element are wrapped to extend about 1-½ins. beyond the core at each end. Two 1-½ inch longitudinal cuts then made, 180° apart, at each end, provide two tabs at each end. One tab is then overlaid (or spliced) onto the inside surface of the long structural element on the segment leading from its junction point towards the head of the racket, while its opposite tab is overlaid at the inside surface of the long structural element on the segment leading from its junction point towards the racket handle.

Tennis rackets made in the manner described above have excellent longitudinal and torsional strength characteristics. However, there have been occasional instances of cracking and failure at the junction points under high stress.

BRIEF SUMMARY OF THE INVENTION

In accordance with the present invention, the tennis rackets are improved by a yoke piece at each of the junction points, each yoke piece having the external shape of the letter "Y" and having a trunk portion and at least two branch portions meeting at a fork point, the trunk portion of each yoke member being at least partially wrapped around said long member in said major portion of said head, a first branch portion of each yoke piece overlying a surface of an end portion of said short member, and a second branch portion of each yoke piece overlying an opposite surface of said end portion of said short member.

Preferably, each yoke piece includes a third branch portion between said first and second branch portions as an extension of said trunk portion beyond said fork point and said third branch portion is at least partially wrapped around said long member at a segment thereof between each junction point and said handle.

BRIEF DESCRIPTION OF THE DRAWINGS

The invention is best understood by reference to the drawings of which.

DETAILED DESCRIPTION

Figure 1:
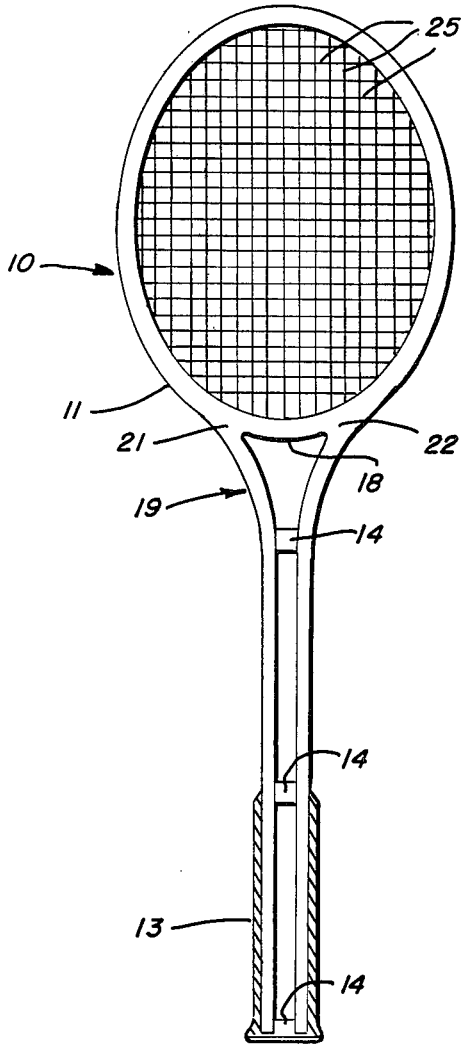
FIG. 1 is a front elevation of a tennis racket employing the composite structure of this invention, the grip again being shown in section.

In the illustrated embodiment of the invention, tennis racket frame 10 comprises long segment 19 including head section 11 and handle section 12 with grip 13 affixed to the lower portion of the handle section. In the handle section, the frame comprises two spaced side-by-side portions connected to each other by cross braces 14. The two portions of the handle separate to a greater distance from each other where the handle joins the head section so that the major portion of the ellipsoid shape of the head section comprises a smooth extension of the portions of the handle section. Short segment 18 completes the ellipsoid of the head portion and joins the long segment at junction points 21 and 22.

Figure 2:
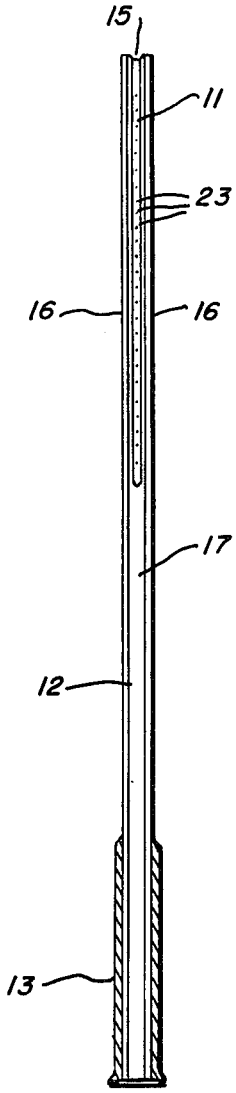
FIG. 2 is a side elevation of a tennis racket of this invention, the grip again being shown in section.

Head section 10, as shown in FIG. 2 has a peripheral recessed groove 15 and a plurality of holes 23 through which strings 25 are attached.

The composite structure of the frame, as shown in the aforementioned application Ser. No. 720,514 (incorporated herein by reference) comprises a foamed plastic core, surrounded by a shell comprising a plurality of layers, each made of a sheet of graphite fibers, resin-coated and unidirectionally oriented at a bias to the length direction of the structure. Each sheet of graphite fibers is arranged at 45° to the long dimension of the structural member, the sheets alternating between +45° and −45° and thus being at right angles to each other. Two opposite faces of the structural member, corresponding to opposite faces of the tennis racket are faced with a final external layer of graphite fiber sheet with fibers aligned along the long dimension of the structural member.

The composite structure of this invention is made in a self-bonding single-step molding process within a rigid mold capable of withstanding the internal forces caused by the pressure developed in the curing cycle. The mold is preferably constructed of tool steel which is chromium plated on its interior surfaces. For short runs, the mold may be constructed of aluminum with anodized interior surfaces.

The graphite fiber sheets used in this invention are made by applying a resinous binder to a sheet of unidirectionally oriented graphite fibers. The resinous binder is applied in liquid state to the graphite fibers and fills the interstices between the fibers before achieving a rigidified state by cooling or curing. The resinous binder may be a thermoplastic material capable of withstanding the curing temperatures to be applied, but is preferably a thermosetting material. Useful thermoplastic materials include nylon, polyethylene, polypropylene, linear polyesters, polycarbonates and acetal resins. Useful thermosetting materials include phenolic resins, cross-linked polyesters, epoxy resins, a specific example being a cyclized epoxy novolac.

The graphite fibers are preferably of medium modulus, ranging from about 30 million to about 40 million pounds per square inch. Where exceptionally high strength and stiffness are desired, graphite fibers of high modulus, ranging from about 50 million to about 60 million pounds per square inch may be used. Individual graphite filaments are generally of extremely fine diameters (of the order of about 0.0003 inches); and the graphite fibers used to make the graphite sheets generally comprise yarns containing hundreds, or thousands, of individual filaments, as is known in the art.

The graphite fiber layers preferably contain a small amount, up to about 5 percent based on the weight of resinous binder, of graphite whiskers which serve to cross link the graphite fibers and reduce the tendency of the fibers to separate, or fray.

The core composition is suitably a composition having the approximate consistency of a firm putty, or of molding clay. Any of the compositions commercially sold as "intumescent" resinous compositions may be used. Intumescent compositions are commercially used as materials for splicing and filling honeycomb cores used in sandwich constructions. The compositions generally comprise an uncured resin, together with a curing agent, a blowing agent, and usually a flow control material which also adds bulk and body at low weight.

The resin in the core composition is typically an epoxy resin or a phenolic resin. The blowing agent is typically either a compound such as an azo, N-nitroso, carbonate, or sulfonyl hydrazide compound which decomposes when heated to yield nitrogen or carbon dioxide, or a volatile normally liquid material such as pentane, water, or a liquid fluorocarbon. Preferred flow control materials include hollow glass or silica microspheres, hollow carbon or graphite microspheres and finely divided expanded vermiculite. Glass or asbestos fibers or mica flakes may also be used. And graphite whiskers may be used advantageously adding strength as well as bulk.

Intumescent resin compositions may be formulated to any desired expansion ratio depending on the amount of blowing agent incorporated. As applied to the instant invention where substantial autogenous pressure in the mold is desired, the intumescent composition has a high expansion ratio and would expand to at least five times its original volume if it were not confined within the mold.

The core composition is formed into strips suitable for use as the long and short segments described above, preferably by molding the composition into a flat slab, then slitting the slab into strips and rolling the strips to a rounded cross section. Preferably, each strip is then inserted into a seamless sleeve, as disclosed in copending and coassigned application Serial No. 703,136, filed July 7, 1976 by Andrew M. Cecka, Pol Dano and Paul G. Pawling.

The core within its sleeve is then wrapped with a plurality of plies of resin-impregnated unidirectional graphite fiber sheets, alternately cross-plied to each other. The plies are preferably wrapped with their fibers running alternately at +45° and −45° to the long dimension of the core, and typically about four layers, are employed. Specifically, two elongated strips are provided, each strip being as long as the desired structural element and at least as wide as two circumferences thereof, one of the strips having fibers running at +45° and the other having fibers running at −45°. The strips are assembled to double thickness and the assembly is wrapped around the core so that there are four layers of graphite fiber sheets with fiber orientation alternating between +45° and −45°.

An additional layer of graphite sheet is laid into the bottom of the mold as a capping layer with its graphite fibers directed along the longitudinal direction of the mold; and the yoke pieces (described below) are then inserted at the positions described below. The wrapped core is formed to the shape of the mold running from one end of the handle up the handle, around the frame and then down the handle to its end. A second short section of wrapped core is inserted into the mold over a capping layer having graphite fibers directed along the length of the member to join the long section at junction points 21 and 22 to obtain a continuum of the composite structure and to complete the closed ellipsoid shape of the head of the frame at the location where the handle sections separate from each other at the location where the handle joins the head.

Figure 5:
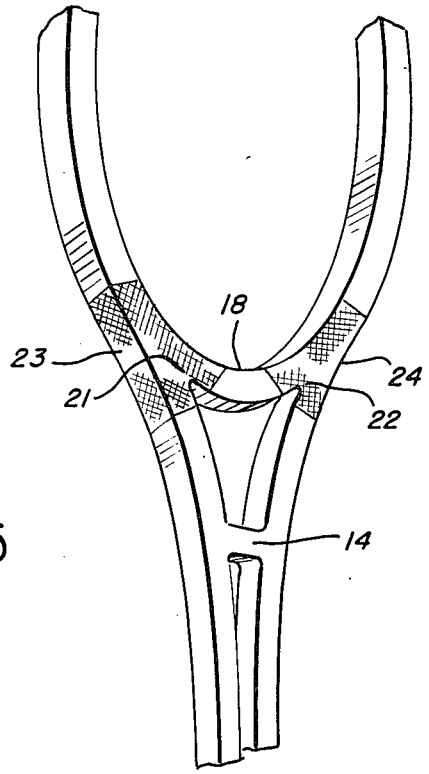
FIG. 5 is a perspective view of a portion of the tennis racket of this invention showing the yoke pieces in wrapped position.
Figure 3:
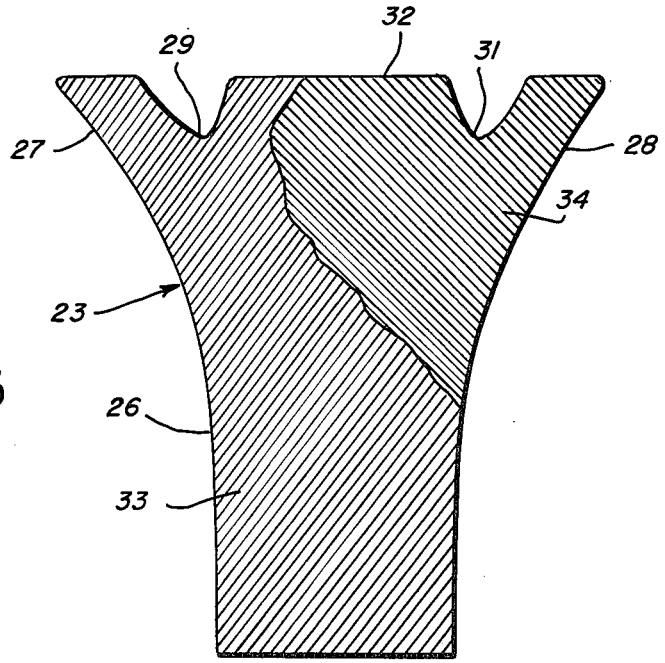
FIG. 3 is an enlarged detail view of a yoke piece which is an element of the tennis racket of this invention, with an underlayer partially exposed.

Yoke pieces 23 and 24 (FIGS. 4 and 5) are shaped as shown in FIG. 3 in the general external shape of the letter "Y" with trunk portion 26 and branch portions 27 and 28 branching from the trunk portion at fork points 29 and 31. As may be seen, the trunk portion is substantially wider than the aforementioned branch portions.

A third branch portion 32 is located between branch portions 27 and 28 as an extension of trunk portion 26 and is of substantially the same width as the trunk portion.

Each yoke piece, as shown in FIG. 3, comprises at least two layers of unidirectionally oriented resin coated graphite fibers, the layers being oriented in directions which are 90° apart. Upper layer 33 has its fibers aligned at +45° to the general direction of the trunk portion; and lower layer 34 has its fibers aligned at −45° to the general direction of the trunk portion.

Figure 4:
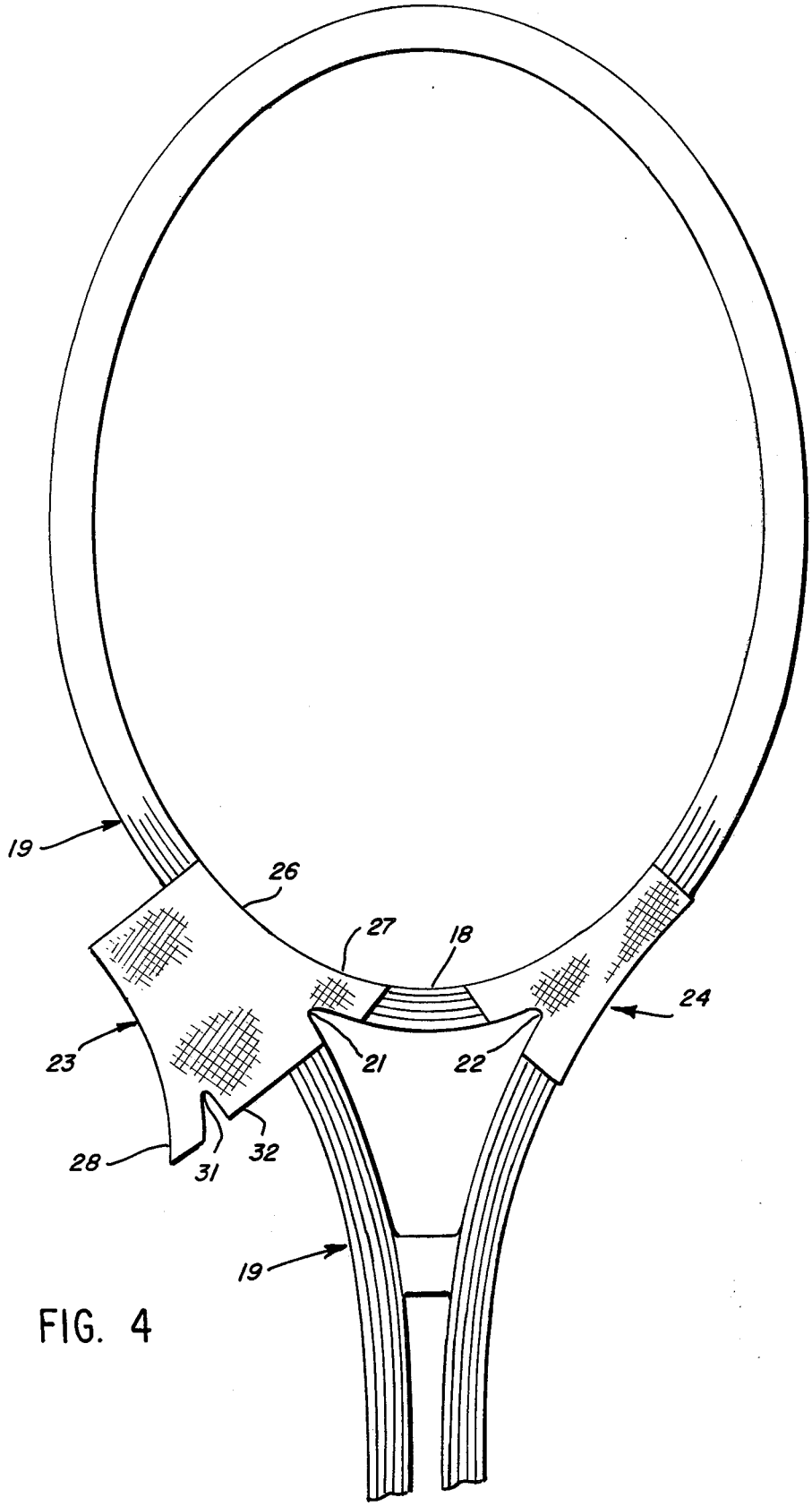
FIG. 4 is a front elevation of the head section and most of the handle section of the tennis racket with the yoke pieces in position at the junction points one yoke piece being wrapped around the long member and the other yoke piece just prior to being so wrapped.

As shown in FIG. 4, yoke piece 23 is placed at junction point 21 with trunk portion 26 lying along long member 19 between the junction point and head of the racket. in this position fork point 29 overlies junction point 21 and branch portion 27 overlies an end of short member 18 from the junction point. The yoke piece is then wound around the long member to the position of yoke piece 24 with the trunk portion being wound around a major portion of the circumference of the long member, corresponding to three sides of its final rectilinear form. In this position, fork point 31 underlies junction point 21 and branch portion 28 underlies an end of short member 18 from the junction point. Branch portion 32 is wrapped around a major portion of the circumference of long member 19 between the junction point and the handle so that it will be wrapped around three sides of the rectilinear cross section of the member in its final configuration.

Capping layers of graphite sheet are then laid upon the short and long members of the wrapped core in the mold with graphite fibers in each case directed along the longitudinal direction of each member. The mold is then closed and clamped and then heated to cure and expand the core composition. The clamping may be by a hydraulic press, by tie bars or high strength clamps; and the mold may be heated by hot platens on a hydraulic press or by insertion into an oven. The curing temperature is suitably in the range of about 150° to about 350° F. and the heating period is suitably from about ½ to about 1 hour, depending on the nature of the resin formulation and the nature of the curing agents.

The heat during the curing cycle activates the foaming agent in the core and causes the foam to expand. As the foam expands, it generates pressure within the confined mold cavity and causes intimate bonding of the core to its sleeve and of the sleeve to the resin-impregnated graphite fiber shell. The generated pressure also serves to bond together the individual graphite fiber layers into a unitary shell with unusual structural capabilities. It is to be understood that the transverse cross-sectional area of the mold cavity is substantially less than would be the transverse cross-sectional area of the wound core material if it were permitted free expansion. The transverse cross-sectional area of the sleeve is somewhat larger than the space within the mold cavity to provide a factor of safety and avoid subjecting the thin sleeve to excessive internal pressure without the backup support of the mold. The sleeve remains slightly crinkled after expansion.

Bonding in this manner under internal pressure produces a composite with excellent structural integrity which exhibits no voids or soft spots. The wraparound of the core by the graphite sheets produces a structure in which the shell completely encases the core at any transverse cross section and thereby provides a box beam construction of exceptional strength and stiffness for its weight. During the expansion of the core material, the graphite sheets, which have only limited expandability, tend to unwind from the core to some extent but nevertheless completely encase it.

Upon completion of the curing cycle, the mold is cooled and then opened; and the molded frame is removed.

Holes for the tennis strings may be drilled in the head but are preferably provided by removable pins inserted into the head portion of the wrapped core before the curing thereof in the mold.

Thereafter the balance of the frame is checked and adjusted, if necessary, by removing material or adding weights. The frame is then painted or coated with a scuff and abrasion resistant paint or film, applied by spraying, dipping, or bonding, followed by curing. The desired grip is then assembled or installed using either an adhesive or mechanical bond. After installation of the tennis strings, weights can be added, if desired, to achieve the desired balance and total weight of the racket.

EXAMPLE

This example describes a preferred embodiment of an improved graphite composite, medium weight tennis racket of this invention and the method for producing it.

The foam core, which subsequently is foamed during curing, was prepared by blending:

| Component | % by Weight |
|---|---|
| Resins | |
| diglycidyl ether from epichlorohydrin and bisphenol A melting at 70° C and having an epoxide equivalent weight of 475 | 7.43 |
| diglycidyl ether from epichlorohydrin and bisphenol A melting at 80° C. and having an epoxide equivalent weight of 600 | 25.79 |
| cycloaliphatic novolac | 11.13 |
| Flow Control Additive | 0.45 |
| Blowing Agents | |
| di-N-nitrosopentanethylene tetraamine (40% + 60% inert filler) | 1.08 |
| azodiisobutyronitrite | 4.62 |
| Accelerator | |
| 3-(3,4-dichlorophenyl) (−1,1-dimethylurea) | 1.08 |
| Curing Agent | |
| dicyandiamide | 6.52 |
| Weight Control Additive | |
| barium sulfate | 27.15 |
| Low Density Filler | |
| chopped cork (−10 mesh) | 14.75 |
| | 100.00 |

The flow control additive was a paste of one part of lamp black in 3 parts of an epichlorohydrin/bisphenol A epoxy resin having an epoxide equivalent weight of 185.

The foam core was prepared by melting and blending the resin components of the formulation together with the flow control, accelerating and curing components; and then adding the other dry constituents, including the inert, weight control additives. Then this mixture was allowed to cool to a solid state, and was subsequently crushed after cooling to produce granules. The granules were formed into a slab shape under heat and pressure. The slab was cut to strips approximately 0.45" by 0.45", which were rolled to about 0.50" diameter.

The rolled foam core was encased in a 0.0015" wall thickness by 5/8" diameter regenerated cellulose core sleeve. This diameter core sealant tube is of a size that essentially fills to full diameter during the curing operation but is somewhat oversized in relation to the mold space so that the sleeve remains somewhat crinkled in the final product.

The sealed foam core next was wrapped with bias cut strips of broadgoods of unidirectionally oriented graphite fibers bonded with an epoxy resin. The broadgoods was prepared by wrapping 55% by weight graphite yarn (fiber tows) on a drum, and impregnating them with 45% by weight of epoxy resin by coating and doctoring. The epoxy resin formulation contained:

| Component | % by Weight |
|---|---|
| cycloaliphatic novolac | 78.13 |
| hardener | 15.62 |
| flow control additive | 3.91 |
| graphite whiskers | 2.34 |
| | 100.00 |

The flow control additive was the same as the flow control additive in the core composition.

The hardener was a mixture of 12 parts by weight of dimethylaminomethyl phenol, 24 parts of p,p'-methylene dianiline and 10 parts of menthane diamine.

The graphite whiskers averaged 100 microns in length and 10 microns in diameter.

After the broadgoods had been staged for 16 hours, strips 3-¾" width were cut on a 45° bias with respect to the axis of the graphite fiber tows. Two strips were assembled to double thickness so that they were applied at ±45° fiber orientations. For each tennis racket, one such bias strip assembly 60" length was required for the main body of the composite tennis racket, a 6" length for the throat piece, and a 1-½" length in the top brace. Then the ±45° bias broadgoods strips were wrapped around the sealed foam core using a rolling machine.

Veils were used when wrapping the sealed foam core. A spun, nonwoven nylon veil about 0.0015" thickness by 2" width and weighing about 2 ounces per square yard with a length slightly longer than the core was wrapped around the core and over the first edge of the bias oriented graphite fiber broadgoods strips to be wrapped around the core. This leading veil helps in starting the rolling or wrapping of the core, and tends to prevent separation of the graphite fibers in the bias cross-plies. A second veil, spun, nonwoven polyester of about 0.006" thickness by 2-½" width and weighing about 4 ounces per square yard with a length slightly longer than the core, was wrapped around the core over the last edge of the bias oriented cross-ply graphite fiber broadgoods strips to be wrapped around the core. This final trailing or outer veil also tends to prevent separation of the graphite fibers in the bias cross-plies. These two veils, especially the outer veil, additionally aid in eliminating surface porosity in the final molded part, and facilitate formation of a uniform resinous film over the surface of the final molded structure.

The cross-ply bias broadgoods strips were wrapped as tightly as possible, and wrapping conditions were optimum when the cross-ply assembly had undergone staging of the resin or had the desired tackiness.

The mold used in producing the tennis racket shape was first cleaned and then further prepared by spraying with a mold release agent.

Capping layers made of graphite fiber plus epoxy resin were placed in the top cavity and in the bottom cavity of the mold. The capping layers were made with the same graphite fibers and the same epoxy resin formulation as described in connection with the bias-cut layers. The lay-up of these graphite tows in the mold for the caps involved a longitudinal orientation placement of an appropriate amount of graphite fibers around the head, through the throat area, down the handle, and through the braces to achieve the desired graphite capping layers on both faces of the final graphite structure. The lay-up sequence generally provided placement of about an equal number of tows in all positions in the cavities in both the top and bottom of the mold. The yoke pieces were then inserted into the mold at the locations corresponding to the junction points of the tennis racket frame.

The wrapped, sealed foam core was placed on top of the capping layer in the bottom cavity of the mold. The 60" length of the wrapped, sealed foam core was placed to extend from the end of one side of the handle upward and around the head and back again to the end of the other side of the handle in a continuous path. The 6" length of wrapped, sealed foamed core for the throat piece was laid into place in the mold over the capping layer therein.

The yoke pieces were then wrapped around the long members and the ends of the short members in the manner illustrated in FIG. 4.

Brace piece 14 was also laid into position and spliced into the long member.

Next, the mold was closed. First, the top part of the mold, which contained the graphite capping layer in the top cavity of the mold was seated on the foam core, and the moveable top of the head was closed. Then, the side parts were closed. The side parts included tapered pins that deformed the graphite plus epoxy resin in the case to produce dimples having a 1/16" radius and a depth of about 0.100" to 0.125". Then, the assembled mold was placed in a press, heated to 300° F. and held for one hour to cure the article. A force of about 15,000 pounds was applied and maintained on the mold during the curing. Then, the mold was opened and the part removed.

The molded graphite composite tennis racket had a uniform cross-section through all parts of the head, with cross-sectional dimensions of about 0.650" height and 0.425" width, with a ⅛" radius on all corners. Dimples for the stringing holes were also molded as described above into the composite to provide reinforcement for the strings by the graphite fibers in the dimples, and a smooth radius to avoid cutting the strings. These dimples provide a means to maintain string tension for a long time, and eliminate the need for grommets, which are undesirable since they tend to become loosened and sometimes break.

The subsequent finishing operations on the improved graphite composite tennis racket followed state-of-the-art practices and do not constitute a portion of this invention.

These finishing operations included deflashing of any excess material, sanding the surfaces smooth, drilling the stringing holes, deburring the stringing holes, and spray finishing the tennis racket with urethane coating. Then, appropriate decals were applied, the grips were assembled onto the racket, and the racket was strung by conventional practices.

The rackets exhibited outstanding properties and excellent playing characteristics, along with long life and good durability and were resistant to the occasional failures at the throat section which had previously occurred in tennis rackets without the yoke pieces.

What is claimed

1. In a tennis racket frame having a substantially rectilinear cross section with opposite faces and having a handle and an ellipsoid head attached to one end of said handle and a grip element at the opposite end of said handle, in which said frame comprises an assembly of a long structural member and a short structural member, each of said members comprising a core of an expanded porous resinous material and a shell comprising at least one layer of resin coated unidirectionally oriented graphite fibers with said shell completely encasing said core at any cross section transverse to the length of said member, in which frame said long member extends from one end thereof at the grip end of said handle, up one side of said handle, around a major portion of the head of said frame and down the other side of said handle to the opposite end of said member at the grip end of said handle, and said short member extends across a minor portion of the head to complete its ellipsoid shape and is attached at its ends to junction points in said long member in the head portion thereof, the improvement comprising a yoke piece at each of said junction points, each yoke piece having the external shape of the letter "Y" and having a trunk portion and at least two branch portions meeting at a fork point, the trunk portion of each yoke member being at least partially wrapped around said long member in said major portion of said head, a first branch portion of each yoke piece overlying a surface of an end portion of said short member, and a second branch portion of each yoke piece overlying an opposite surface of said end portion of said short member.

2. The tennis racket frame of claim 1 wherein each of said yoke pieces includes a third branch portion between said first and second branch portions as an extension of said trunk portion beyond said fork point and said third branch portion is at least partially wrapped around said long member at a segment thereof between each junction point and said handle.

3. The tennis racket frame of claim 2 wherein said shell of each of said structural members comprises at least two layers of resin coated unidirectionally oriented graphite fibers, at least one of said layers being oriented at +45° with respect to the length of said member and at least one other layer being oriented at −45° with respect to the length of said member.

4. The tennis racket frame of claim 2 wherein each of said yoke members contains at least two layers of resin coated unidirectionally oriented graphite fibers, said layers being oriented in different directions.

5. The tennis racket frame of claim 4 wherein said layers in said yoke members are oriented in directions which are 90° apart.

6. The tennis racket frame of claim 2 wherein said trunk portion and said third branch portion of each of said yoke members are substantially wider than said first and second branch portions.

7. The tennis racket frame of claim 6 wherein each of said trunk portions is wide enough to cover at least three surfaces of said rectilinear cross section of said structural members at each of said junctions.

8. A yoke piece for reinforcement of a tennis racket frame comprising a thin, flexible member having the external shape of the letter "Y" with a trunk portion, with two symmetrical branch portions meeting at a fork point and with a third branch portion between said symmetrical branch portions as an extension of said trunk portion beyond said fork point, said trunk portion and said third branch portions being wider than said symmetrical branch portions, and said member comprising at least two layers of resin coated unidirectionally oriented graphite fibers with the direction of the fibers in one of said layers differing from the direction of the fibers in another of said layers.

9. The yoke piece of claim 8 wherein the direction of the fibers in one of said layers is 90° removed from the direction of the fibers in another of said layers.

* * * * *